US009782647B2

(12) United States Patent
Hill

(10) Patent No.: US 9,782,647 B2
(45) Date of Patent: Oct. 10, 2017

(54) COMBINATION BAT WARMER/SEAT CUSHION

(71) Applicant: Michael F. Hill, Olney, IL (US)

(72) Inventor: Michael F. Hill, Olney, IL (US)

( * ) Notice: Subject to any disclaimer, the term of this patent is extended or adjusted under 35 U.S.C. 154(b) by 10 days.

(21) Appl. No.: 14/963,678

(22) Filed: Dec. 9, 2015

(65) Prior Publication Data

US 2017/0165550 A1 Jun. 15, 2017

(51) Int. Cl.

| | |
|---|---|
| ***A47C 9/10*** | (2006.01) |
| ***A45C 13/02*** | (2006.01) |
| ***A63B 60/60*** | (2015.01) |
| ***A47C 1/16*** | (2006.01) |
| ***A47C 7/62*** | (2006.01) |
| ***A47C 7/02*** | (2006.01) |

(52) U.S. Cl.

CPC ..... *A63B 60/60* (2015.10); *A47C 1/16* (2013.01); *A47C 7/021* (2013.01); *A47C 7/62* (2013.01)

(58) Field of Classification Search

CPC ... A45C 13/02; A45C 2013/026; A63B 60/60; A63B 71/0045; A63B 2102/18; A47C 7/021; A47C 7/62; A47C 1/16

USPC ..... 5/653; 297/188.01, 188.08, 188.13

See application file for complete search history.

(56) References Cited

U.S. PATENT DOCUMENTS 2,123,031 A * 7/1938 Weiner ..... A47J 41/00 126/261
2,889,863 A * 6/1959 Arnold, Jr. ..... A63B 55/00 206/315.1
3,120,319 A * 2/1964 Buddrus ..... B65D 23/0885 206/523
3,181,693 A * 5/1965 Freistat ..... A45C 13/02 206/523
3,241,661 A * 3/1966 Zamzow ..... B65D 81/022 206/433
3,591,768 A * 7/1971 Torres ..... A45C 11/20 206/543
3,763,972 A * 10/1973 Karzmar ..... A45C 9/00 190/8
3,974,658 A * 8/1976 Starrett ..... B65D 25/02 206/427
3,998,072 A * 12/1976 Shaw ..... B65D 81/3876 62/372
4,108,492 A * 8/1978 Kirby ..... A47C 7/021 297/284.3
4,210,363 A * 7/1980 Taipalus ..... A47C 9/10 190/8

(Continued)

*Primary Examiner* — Robert Canfield
(74) *Attorney, Agent, or Firm* — Gary K. Price

(57) ABSTRACT

A bat warmer seat cushion device that includes a first side and a second side and includes at least one elongated cylindrical sleeve member disposed within the bag, the sleeve member sized and shaped for receiving a bat. The sleeve member includes an open end that is generally aligned with an open end of the first side. A soft sleeve is disposed within each sleeve member, the soft sleeve having an open end aligned with the first side's open end. Insulating material is disposed around the sleeve member that provides thermal protection for the encased bats. The entire bag includes an outer layer and insulating padding sandwiched between the outer layer and the components of the present invention. The bag with the outer layer and insulating padding can serve as a seat cushion which allows a spectator to view an event more comfortably.

16 Claims, 3 Drawing Sheets

(56) References Cited

U.S. PATENT DOCUMENTS 4,338,795 A * 7/1982 House, Jr. ..... A45C 11/20 62/372
4,474,407 A * 10/1984 Nazar ..... A47C 1/146 297/183.3
4,533,050 A * 8/1985 Bake, Jr. ..... A45C 9/00 206/217
4,549,410 A * 10/1985 Russell ..... A45C 11/20 215/13.1
4,652,048 A * 3/1987 Nazar ..... A47C 7/62 297/188.01
4,793,532 A * 12/1988 Cash ..... A45C 7/0095 206/315.1
4,805,776 A * 2/1989 Namgyal ..... A45C 3/00 206/523
4,822,309 A * 4/1989 Vandenberg ..... A45C 9/00 297/188.01
4,858,444 A * 8/1989 Scott ..... A45C 11/20 62/372
4,871,069 A * 10/1989 Guimont ..... A45C 11/20 190/1
4,877,128 A * 10/1989 Strickland ..... A61J 1/165 206/170
4,914,836 A * 4/1990 Horovitz ..... A43B 13/206 139/384 R
5,063,912 A * 11/1991 Hughes ..... A47D 15/001 446/295
5,118,555 A * 6/1992 Horovitz ..... A43B 13/206 139/384 R
5,224,602 A * 7/1993 Bettles ..... A63B 71/0045 206/315.1
5,573,288 A * 11/1996 Raffensperger ..... A47C 1/16 297/188.1
5,687,705 A * 11/1997 Blair ..... F24C 3/14 126/226
5,695,067 A * 12/1997 Harvey ..... A45C 13/02 206/315.1
6,067,813 A * 5/2000 Smith ..... A45C 11/20 62/371
6,067,816 A * 5/2000 Hodosh ..... A45C 11/20 220/592.17
6,247,469 B1 * 6/2001 Guard ..... A63B 71/0045 126/229
6,427,475 B1 * 8/2002 DeFelice ..... F25D 3/08 62/457.2
D476,151 S * 6/2003 Peterson ..... D3/221
6,588,840 B1 * 7/2003 Lombardo ..... A47C 1/16 297/188.08
6,609,392 B1 * 8/2003 Brown ..... A61J 1/165 220/512
7,316,123 B2 * 1/2008 Gano ..... F25D 3/125 62/371
7,419,070 B2 * 9/2008 Cantwell ..... B65D 81/3876 220/592.01
7,565,974 B2 * 7/2009 Adams, Jr. ..... A45C 13/02 190/109
9,533,744 B2 * 1/2017 Leatherman ..... B63C 9/26
2004/0262178 A1 * 12/2004 Speck ..... A63B 55/00 206/315.1
2006/0188610 A1 * 8/2006 Powell ..... A45C 7/0063 426/87
2007/0125670 A1 * 6/2007 Lin ..... A47B 81/005 206/315.1
2012/0091019 A1 * 4/2012 Lin ..... A45C 13/02 206/315.1
2013/0000257 A1 * 1/2013 Waltrip ..... B65D 85/30 53/449

* cited by examiner

COMBINATION BAT WARMER/SEAT CUSHION

CROSS REFERENCES TO RELATED APPLICATIONS

U.S. Provisional Application for Patent No. 62/090,107, filed Dec. 10, 2014, with title "Combination Bat Warmer/Seat Cushion" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

The present invention relates to a baseball bat warmer and more particularly pertains to providing a sleeve or plurality of sleeves for warming a baseball bat during hot and cold temperatures, and further provides a seat cushion to be used, for example, at sporting events.

2. Brief Description of Prior Art

The use of a baseball bat sleeve is known in the prior art. More specifically, baseball bat sleeves heretofore devised and utilized for the purpose of placement of a baseball bat are known to consist basically of familiar, expected, and obvious structural configurations, notwithstanding the myriad of designs encompassed by the crowded prior art which has been developed for fulfillment of countless objectives and requirements.

While these devices fulfill their respective, particular objectives and requirements, the prior art does not describe a baseball bat warmer generally used in hot or cold weather to maintain the bat's temperature at or above the ambient temperature for better equipment performance. And further fails to provide such a device that provides a seat cushion that can be used as a cushion for bleacher or stadium seats. Thus, for example, a player is able to transport a baseball bat or bats to a sports event in the present device and upon arrival utilize the device as a soft seat over a hard bleacher bench. In youth sports for example, it is known for a family member to carry a youth's bat bag to the event and it is further anticipated that the family member/user will want to carry a seat cushion or otherwise provide for a seat cushion. In this respect, the device according to the present invention substantially departs from the conventional concepts and designs of the prior art, and in doing so provides a bag for carrying a bat or bats, that is a natural warmer for the bat or bats, and provides a seat cushion which allows the spectator to view an event more comfortably.

None of the disclosures teach a seat cushion with pockets for carrying at least one baseball bat. Therefore, it can be appreciated that there exists a continuing need for a new and improved baseball bat warmer that serves as a natural warmer for a baseball bat during hot or cold temperatures, and providing a comfortable seat cushion. In this regard, the present invention substantially fulfills this need.

SUMMARY OF THE INVENTION

A combination baseball bat warmer seat cushion device preferably having a rectangular shaped bag that includes at least one hollow tubular-shaped spacing that extends the length of the bag and has opposite open ends. The bag consists of a first side and a second side that include apertures in communication with the hollow spacing. An elongated cylindrical sleeve member is disposed within each tubular-shaped spacing. The sleeve member sized and shaped to receive a baseball bat. The sleeve member also includes opposite open ends that are generally aligned with the open ends of the spacing.

A soft sleeve is disposed within each sleeve member and receives the bat within the sleeve member when being stored. The soft sleeve is in communication with the aperture on both sides for ease of placing and/or removing bats from the sleeve member. An insulating material is disposed between the soft sleeve and the sleeve member that provides thermal protection for the encased bats. The sides can further include a flap or cover that can be releasably secured in place for enclosing the apertures and the interior cavity.

The entire bag includes an outer layer and insulating padding sandwiched between the outer layer and the components of the present invention. The outer layer with the insulating padding as described can serve as a seat cushion, with or without bats disposed within the sleeve member which allows a spectator to view an event more comfortably.

The bottom of the bag can include at least one arm strap employed to support the device on the user's back or shoulder. A handle disposed on an end is an alternative way of carrying the bag.

DESCRIPTION OF THE PREFERRED EMBODIMENT

The present invention is directed to an apparatus for carrying a baseball bat or bats, or articles having a similar structure, and is used to maintain the bat's temperature at or above the ambient temperature for better equipment performance, and serves as a seat cushion which allows the spectator to view an event more comfortably. In the broadest context, the device of the present invention consists of components configured and correlate with respect to each other so as to attain the desired objective.

Metal and composite baseball bats, for example, are known to experience a change in properties, often becoming harder in colder temperatures and softer in warmer temperatures. When a bat is used during these periods of hot and cold temperatures, it is likely to be more susceptible to dings and knocks, among other types of damages. A device made according to the present invention's insulated properties serve to keep a bat warmer in colder temperatures, and vice versa.

As used herein, the term "bat" includes a baseball bat, softball bat, or any other article having a similar structure, used in either a recreational or non-recreational setting, or otherwise.

Figure 1:
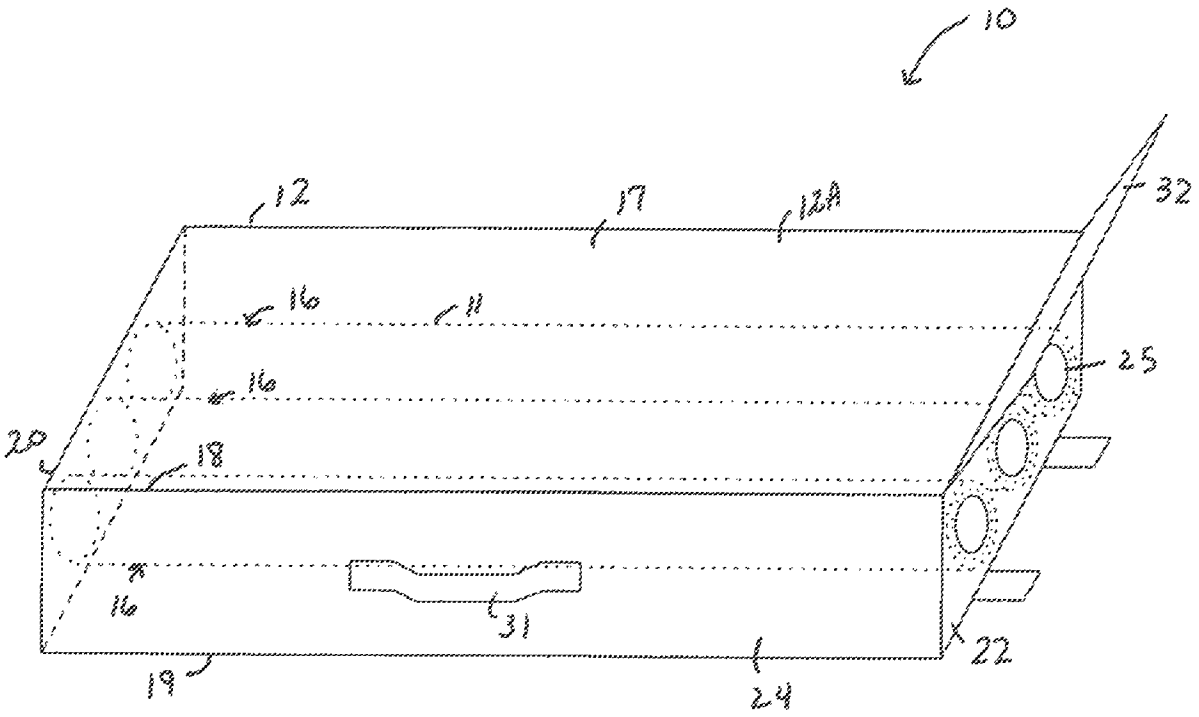
FIG. 1 illustrates a top perspective view of the preferred embodiment of the present invention, a combination bat warmer/seat cushion.
Figure 3:
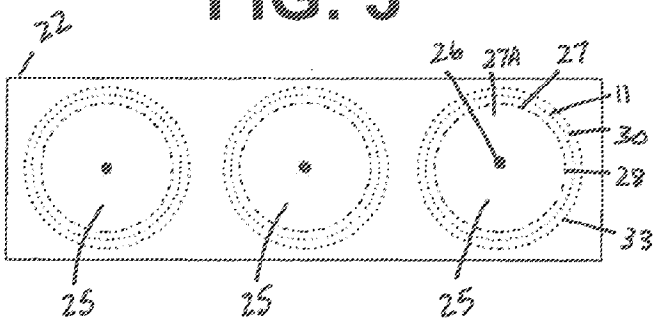
FIG. 3 is a second side view of the device of FIG. 1.
Figure 2:
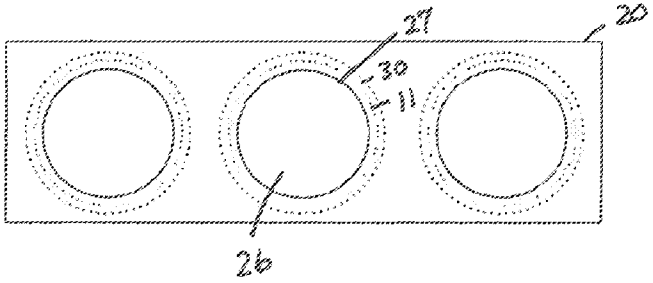
FIG. 2 is a first side view of the device of FIG. 1.
Figure 4:
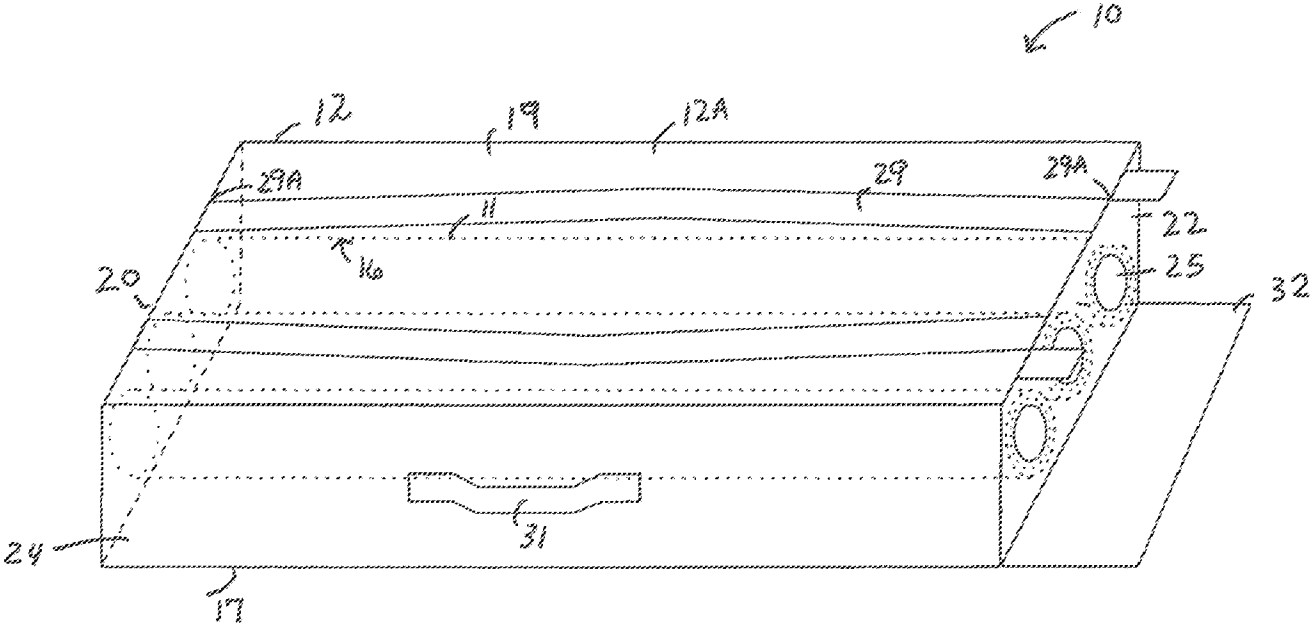
FIG. 4 is a bottom perspective view of the device of FIG. 1.

The present invention, a combination baseball bat warmer seat cushion device 10, is comprised of a plurality of components. Such components in their broadest context include a preferably rectangular shaped bag 12, that include at least one hollow tubular-shaped spacing 16 (shown in broken lines in FIGS. 1 and 4 for ease of illustration) that extends the length of the bag 12 and has opposite open ends. As illustrated, the bag 12 includes a top 17, a bottom 19, a first side 20, and a second side 22. Side 22 including separate apertures individually referenced as numeral 25 (see FIG. 3), each aperture 25 in communication with the respective hollow spacing 16.

In the preferred embodiment, the top 17 of the bag 12 includes an enclosure 18 that can be securely shut by various known means, such as a zipper, snaps or pile-type fastener system to encase all of the components of the bag 12.

an elongated cylindrical sleeve member 11 is disposed within each tubular-shaped spacing 16. The sleeve member 11 defines an interior cavity that is sized and shaped so to receive a bat (not shown). The sleeve member 11 further includes an open end that is generally aligned with the open end of the spacing 16 and apertures 25.

A soft sleeve 27 (see FIG. 3) is further disposed within each sleeve member 11 and receives the bat within the sleeve member 11 when being stored. The soft sleeve 27 has an open end 27A in communication with the aperture 25 on the second side 22, and a closed end 26, opposite the open end 27A, adjacent the first side 20. The soft sleeve 27 is further attached 28 to the first side 20. and the second side 22 to allow for ease of placing and/or removing bats from the sleeve member 11. As described, each soft sleeve 27 is encased in the more rigid sleeve member 11 to further provide for support of the bag 12, while safely storing the bats. An insulating material 30 is disposed around the exterior of the sleeve member 11 that provides thermal protection for the encased bats.

The sides 20 and 22 can further include a flap or cover 32 that can be releasably secured in place for enclosing the apertures 25 and the interior cavity, thereby protecting the bats stored within the sleeve member 11 from the elements. The flap 32 can be secured in place by various known means, such as snaps or a pile-type fastener system.

The entire bag 12 includes an outer layer 12A which is preferably a soft non-abrasive lightweight fabric having water-repellant properties and is used to form the rectangular shaped bag 12. Insulating padding 33 is sandwiched between the outer layer 12A and sleeve member 11 and insulating material 30. The outer layer with the insulating padding as described can serve as a seat cushion, with or without bats disposed within the sleeve member 11 which allows a spectator to view an event more comfortably.

A mesh layer (not shown) is preferably disposed between the insulating material 30 and the insulating padding 33. The mesh layer for maintaining the insulating material 30 in place and not shifting during use.

As such, in the preferred embodiment, the device 10 as disclosed consists of a combination bat warmer/seat cushion consisting of multiple layers as follows: the soft sleeve 27 disposed within the cylindrical sleeve member 11 with a layer of insulating material 30 wrapped around the sleeve member 11, the insulating padding 33 between the sleeve member 11 and the outer layer 12A with the mesh layer positioned between the insulating material 30 and insulating padding 33.

The bottom 19 of the bag 12 can further include at least one arm strap 29 employed to support the device 10 on the user's back or shoulder. Each at least one strap 29 includes ends 29A secured on opposite ends of the bottom 19, adjacent the first and second sides 20, 22. An end 24 of the bag 10 can further include a handle 31 as an alternative way of carrying the bag 10.

In order to use the combination bat warmer/seat cushion device 10, the user merely slips either end of the bat into one of the apertures 25 until the bat is completely within the soft sleeve 27 of one of the sleeve members 11, and then pulls the side flap(s) down over the first and/or second sides 20, 22. With the device 10 closed and the side flap(s) attached to the skies of the bag, the device is thus available as a seat cushion unobstructed by the flips and bags) that might be in the sleeve member(s). It should be understood that in this condition the device is available as a seat cushion with or without bat(s) within the sleeve member(s).

Although the above description contains many specificities, these should not be construed as limiting the scope of the invention but as merely providing illustrations of some of the presently preferred embodiments of this invention. As such, it is to be understood that the present invention is not limited to the embodiments described above, but encompasses any and all embodiments within the scope of the claims.

It would be obvious to those skilled in the art that modifications may be made to the embodiments described above without departing from the scope of the present invention. Thus the scope of the invention should be determined by the appended claims in the formal application and theft legal equivalents, rather than by the examples given.

I claim:

1. A bat warmer seat cushion device comprising:

a bag that includes at least one spacing that extends the length of the bag, said bag having a substantially flat top, a bottom, first and second sides, and wherein each of said at least one spacings include an aperture disposed in said first side, a cylindrical sleeve disposed within each of said at least one spacings, said cylindrical sleeve extends from said first side to said second side and includes an open end aligned with said aperture, and an insulating material disposed between the cylindrical sleeve and an outer layer of said bag.

2. The bat warmer as recited in claim 1, further including a second sleeve disposed within said cylindrical sleeve, said second sleeve having an open end aligned with said aperture and attached to said first side.

3. The bat warmer as recited in claim 2, said second sleeve having a closed end opposite said open end of said second sleeve, said closed end attached to said second side.

4. The bat warmer as recited in claim 3, wherein said insulating material is wrapped around said cylindrical sleeve.

5. The bat warmer as recited in claim 4, further including insulating padding disposed between said insulating material and said outer layer.

6. The bat warmer as recited in claim 5, wherein the bag has a rectangular configuration.

7. A combination bat warmer seat cushion device comprising:

a bag that includes at least one spacing that extends the length of the bag, said bag having a top, a bottom, a first side and a second side, and wherein each of said at least one spacings include an aperture disposed in said first side, an elongated cylindrical sleeve member disposed within each spacing, said cylindrical sleeve having an interior cavity sized and shaped to receive a bat and further includes an open end that is generally aligned with said aperture, a second sleeve disposed within each sleeve member, said second sleeve sized for receiving the bat within the sleeve member, and wherein said second sleeve having an open end that is generally aligned with said aperture and attached to said first side, and a closed end attached to the second side, an insulating material wrapped around said sleeve member, insulating padding sandwiched between said insulating material and an outer layer of said bag.

8. The device as recited in claim 7, wherein the bag is a rectangular shaped bag.

9. The device as recited in claim 8, wherein said bottom includes at least one arm strap employed to support the device on a user's back or shoulder.

10. The device as recited in claim 9, further including a handle disposed on an end of said bag.

11. The device as recited in claim 10, further including a flap disposed on said first side releasabiy secured in place for enclosing the separate apertures and the interior cavity.

12. A bat warmer seat cushion device comprising:

a bag having a substantially flat top, a bottom, first and second sides, and wherein said first side includes at least one aperture, a sleeve member disposed within said bag, said sleeve member extending from said first side to said second side and having an open end aligned with said at least one aperture, an insulating material disposed around said sleeve member.

13. The bat warmer as recited in claim 12, further including a second sleeve disposed within the sleeve member, said second sleeve having an open end aligned with said at least one aperture and attached to said first side.

14. The bat warmer as recited in claim 13, said second sleeve having a closed end opposite said open end of said second sleeve, said closed end attached to said second side.

15. The bat warmer as recited in claim 14, further including an insulating padding disposed between the insulating material and the outer layer.

16. The bat warmer as recited in claim 15, wherein the bag has a rectangular configuration.

* * * * *